US008458836B2

(12) United States Patent
Shelby

(10) Patent No.: US 8,458,836 B2
(45) Date of Patent: Jun. 11, 2013

(54) ENCAPSULATED MATTRESS WITH INTEGRATED PILLOW

(75) Inventor: Timothy W. Shelby, High Point, NC (US)

(73) Assignee: MTJ American LLC, Granite Falls, NC (US)

( * ) Notice: Subject to any disclaimer, the term of this patent is extended or adjusted under 35 U.S.C. 154(b) by 0 days.

(21) Appl. No.: 13/349,372

(22) Filed: Jan. 12, 2012

(65) Prior Publication Data

US 2012/0102697 A1 May 3, 2012

Related U.S. Application Data

(62) Division of application No. 11/906,848, filed on Oct. 4, 2007, now Pat. No. 8,096,009.

(51) Int. Cl.
*A47C 27/14* (2006.01)

(52) U.S. Cl.
USPC ..... 5/690; 5/733; 5/657; 5/737

(58) Field of Classification Search
USPC ..... 5/690, 694, 417, 419, 413 R, 413 AM, 5/733, 657.5, 737
See application file for complete search history.

(56) References Cited

U.S. PATENT DOCUMENTS

| | | | |
|---|---|---|---|
| 712,720 | A | 11/1902 | Richardson |
| 1,648,373 | A | 11/1927 | Vilas |
| 4,087,874 | A | 5/1978 | Callaway et al. |
| 4,843,666 | A | 7/1989 | Elesh et al. |
| 5,548,858 | A | 8/1996 | Shoa |
| 5,640,725 | A | 6/1997 | Ando et al. |
| 6,351,864 | B1 | 3/2002 | Karafa et al. |
| 6,516,482 | B2 | 2/2003 | Karafa et al. |
| 6,651,277 | B1 | 11/2003 | Marson |
| 6,701,558 | B2 | 3/2004 | VanSteenburg |
| 6,785,923 | B2 | 9/2004 | Karafa et al. |
| 2004/0255379 | A1 | 12/2004 | Zheng |
| 2007/0094808 | A1 | 5/2007 | Jansen |
| 2008/0005845 | A1 | 1/2008 | Moran Pfleger |

*Primary Examiner* — William Kelleher
(74) *Attorney, Agent, or Firm* — Faegre Baker Daniels LLP

(57) ABSTRACT

A method of integrating a pillow, including stuffing, within an encapsulated mattress having a core and covering surrounding the core is disclosed. A mattress for use in institutions, such as correctional facilities, detention centers, rehabilitation centers, hospitals and the like, includes a core formed of a padding material, a pillow adjoining the core, the pillow containing stuffing, and a covering surrounding the core and the pillow. Also disclosed is a mattress including a core formed of a padding material, a pillow adjoining the core using a sleeve, the pillow containing stuffing, the sleeve retaining the pillow to the core, and a covering surrounding the core and the pillow.

16 Claims, 4 Drawing Sheets

ENCAPSULATED MATTRESS WITH INTEGRATED PILLOW

CROSS-REFERENCE TO RELATED APPLICATIONS

This application is a divisional application of U.S. application Ser. No. 11/906,848, filed Oct. 4, 2007, the disclosure of which is expressly incorporated herein by reference.

BACKGROUND

The present invention relates to mattresses used in institutions, such as correctional facilities, detention centers, rehabilitation centers, hospitals and the like, and, more particularly, to mattresses that integrate a pillow including stuffing.

Institutions, such as correctional facilities, jails, penitentiaries, detention centers, rehabilitation centers, hospitals and the like, house numerous people overnight. Accordingly, these institutions typically must provide bedding for each inmate, patient or guest. Such bedding typically includes at least a mattress, and sometimes a pillow in order to provide support for the body and head during rest.

Fluid, such as water, blood, oil, urine, or other undesirable matter, such as feces, insects, bacteria, viruses, may soil the bedding requiring cleaning, sanitizing or entirely replacing the bedding at high cost in money, time, and labor. Thus it is known to encapsulate the mattress in order to keep the bedding clean.

SUMMARY

The present disclosure provides a method of integrating a pillow, including stuffing, within an encapsulated mattress having a core and covering surrounding the core. The following steps are included: adjoining the pillow with the mattress using a sleeve and encapsulating the pillow with the covering.

The present disclosure also provides a mattress including a core formed of a padding material, a pillow adjoining the core, the pillow containing stuffing, and a covering surrounding the core and the pillow.

The present disclosure also provides a mattress including a core formed of a padding material, a pillow adjoining the core using a sleeve, the pillow containing stuffing, the sleeve retaining the pillow to the core, and a covering surrounding the core and the pillow.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Figure 1:
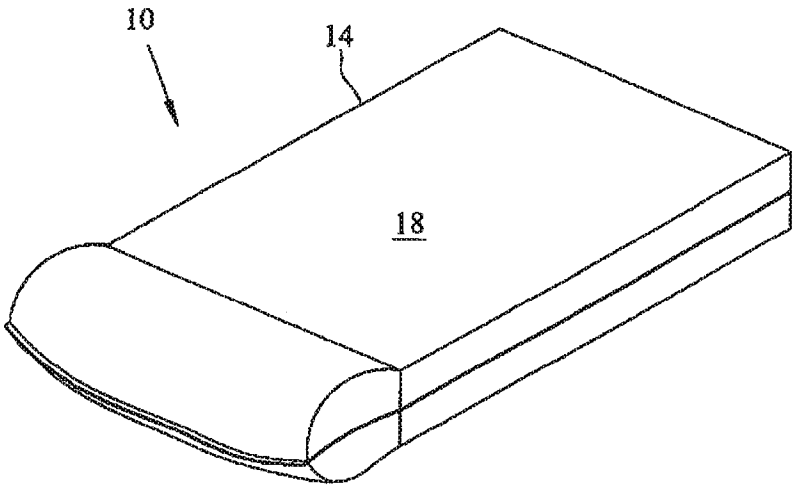
FIG. 1 is a perspective view of a mattress according to one embodiment of the present disclosure.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE EXEMPLARY EMBODIMENTS

The embodiments disclosed below are not intended to be exhaustive or limit the invention to the precise forms disclosed in the following detailed description. Rather, the embodiments are chosen and described so that others skilled in the art may utilize their teachings.

Referring to FIG. 1, mattress 10 in accordance with one embodiment of the present disclosure is illustrated. Mattress 10 includes covering 14. Covering 14 includes inner surface (not shown), which is disposed proximal to core 12 (FIG. 2) and opposing outer surface 18. Inner surface may include nylon. Outer surface 18 may include polyurethane.

Figure 2:
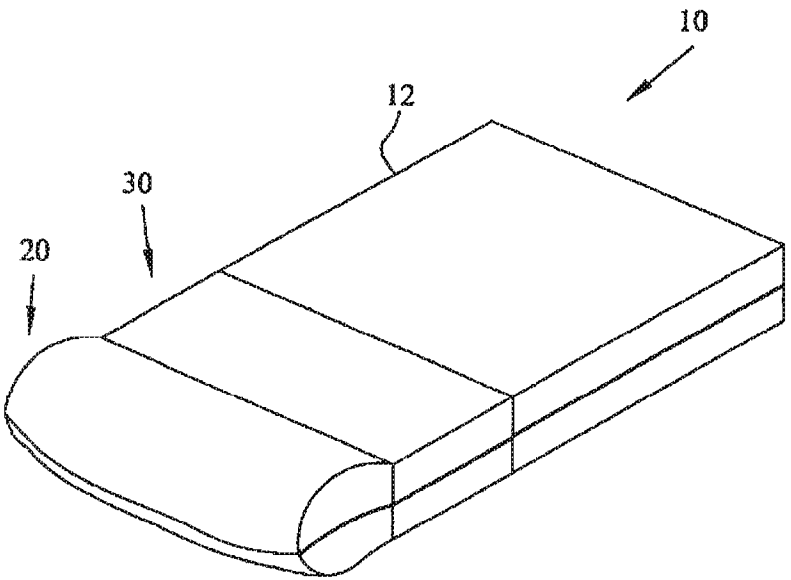
FIG. 2 is a perspective view of the mattress of FIG. 1 wherein the covering has been removed.

Covering 14 provides a barrier against fluids and other undesirable matter contacting pillow 20 (FIG. 2) or core 12 (FIG. 2). Covering 14 is also durable, extending the useable life of mattress 10. As illustrated, cover 14 encapsulates pillow 20 and core 12. Furthermore, since cover 14 encapsulates both pillow 20 and core 12, cover 14 is at least capable of adjoining pillow 20 and core 12.

Referring now to FIG. 2, mattress 10 is shown with cover 14 (FIG. 1) removed. Mattress 10 is shown including core 12, and pillow 20 adjoining core 12. Sleeve 30 is also shown adjoining pillow 20 and at least partially covering core 12. Sleeve 30 aids in adjoining pillow 20 and core 12.

Core 12 may be formed of any padding material suitable for use in mattress 10. Such padding material may include, for example, various urethane foams, densified polyester padding, silicone foam, neoprene foam, cotton padding, various batting or other mixtures thereof. The padding material may be formed using any means including, for example, vertical folding technology developed by and available from Shinih Enterprise Company Limited, Taipei, Taiwan.

As illustrated, pillow 20 may be formed of any stuffing suitable for use, including filler, foam, synthetic fills, feathers or down, or plastic. Several embodiments or ways to form pillow 20 are described in greater detail below. Several embodiments or several ways to form mattress 10 are described in patent application Ser. No. 11/811,714, filed Jun. 12, 2007, titled ENCAPSULATED AND FILTERED MATTRESS, disclosure of which is incorporated by reference herein.

Figure 3:
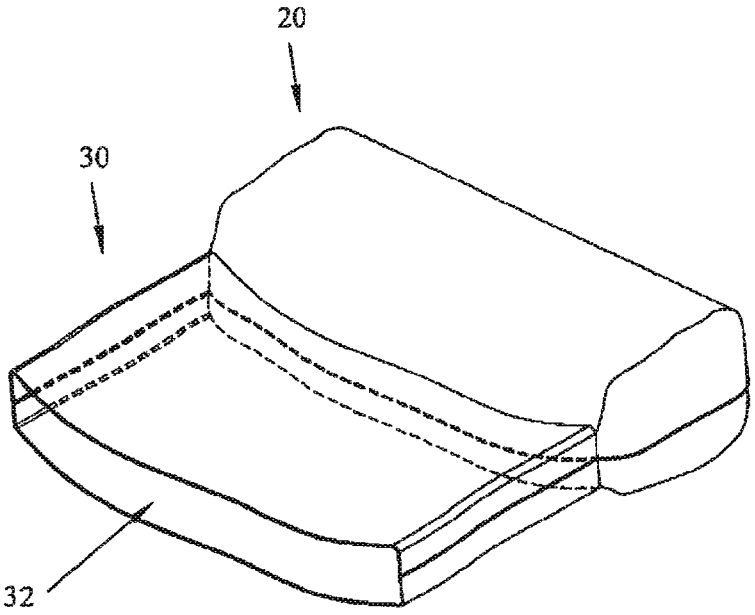
FIG. 3 is a perspective view of the pillow and sleeve of FIG. 2.

Now referring to FIG. 3, pillow 20 and sleeve 30 are illustrated. Sleeve 30 defines core cavity 32. Core cavity 32 is configured to slidably receive core 12 (FIG. 2). In this embodiment, sleeve 30 may be configured to slidably receive core 12 such that core 12 may abut pillow 20. As illustrated, sleeve 30 may be configured such that four corners of core 12 may be substantially adjoined or adjacent to pillow 20. Core cavity 32 may be defined such that at least a portion of core 12 (FIG. 2) snugly fits within sleeve 30.

Figure 4:
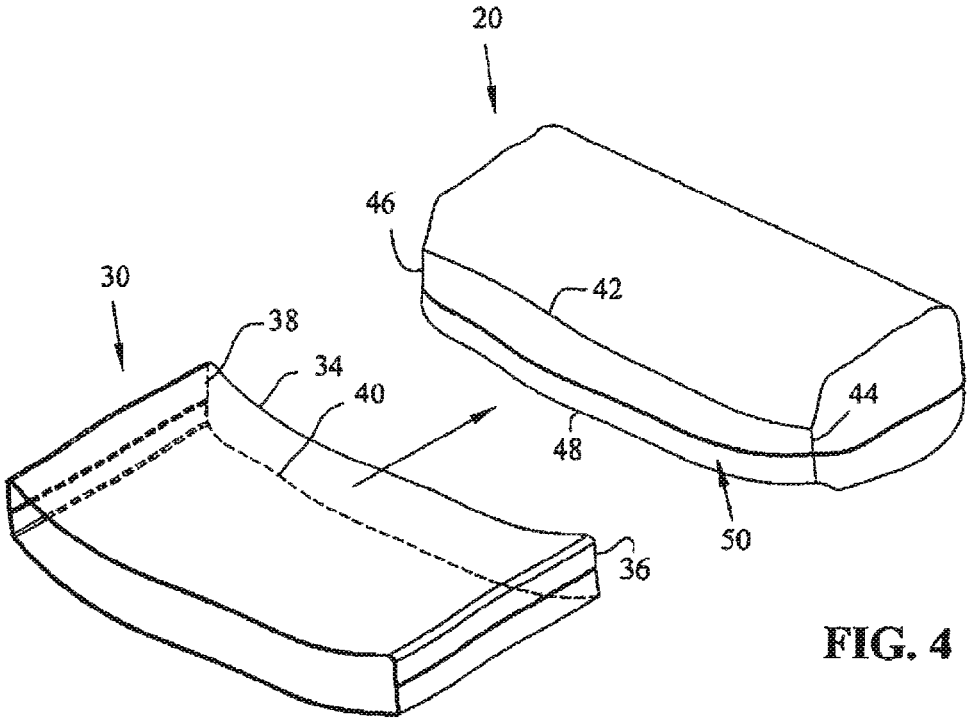
FIG. 4 is an exploded view of the pillow and sleeve of FIG. 3 according to one embodiment of the present disclosure.

Now referring to FIG. 4, in this embodiment, pillow 20 and sleeve 30 are shown prior to fastening. Pillow 20 and sleeve 30 may be fastened by numerous methods using any suitable means including, for example, heat sealing, sewing, thermal or sonic welding, adhesive bonding, and/or chemical bonding. As illustrated, sleeve 30 may be shaped to have a hollow interior and a rectangular cross-section. Furthermore, sleeve 30 may define four seaming edges 34, 36, 38, and 40. Sleeve seaming edges 34, 36, 38, and, 40 are configured to seam to pillow 20 along pillow seaming edges 42, 44, 46, and 48, respectively.

Pillow 20 may include or may define barrier portion 50. Barrier portion 50 may be integral with pillow 20. Also barrier 50 may be external to pillow 20. Barrier portion 50 provides a barrier between the interior of pillow 20 and core cavity 32 (FIG. 3). As such, barrier portion 50 prevents core 12 (FIG. 2) from being inserted within the interior of pillow 20. Furthermore, barrier portion 50 may be configured such that four corners of core 12 may be substantially adjoined or adjacent to pillow 20.

Figure 5:
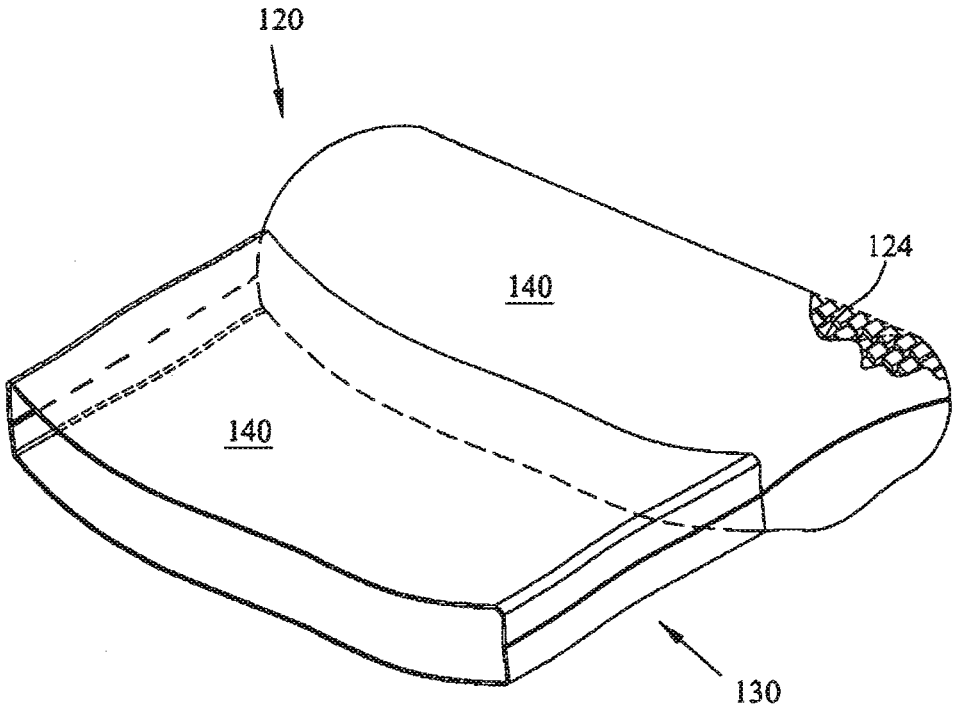
FIG. 5 is a perspective view of the pillow and sleeve of FIG. 3 according to another embodiment of the present disclosure.
Figure 6:
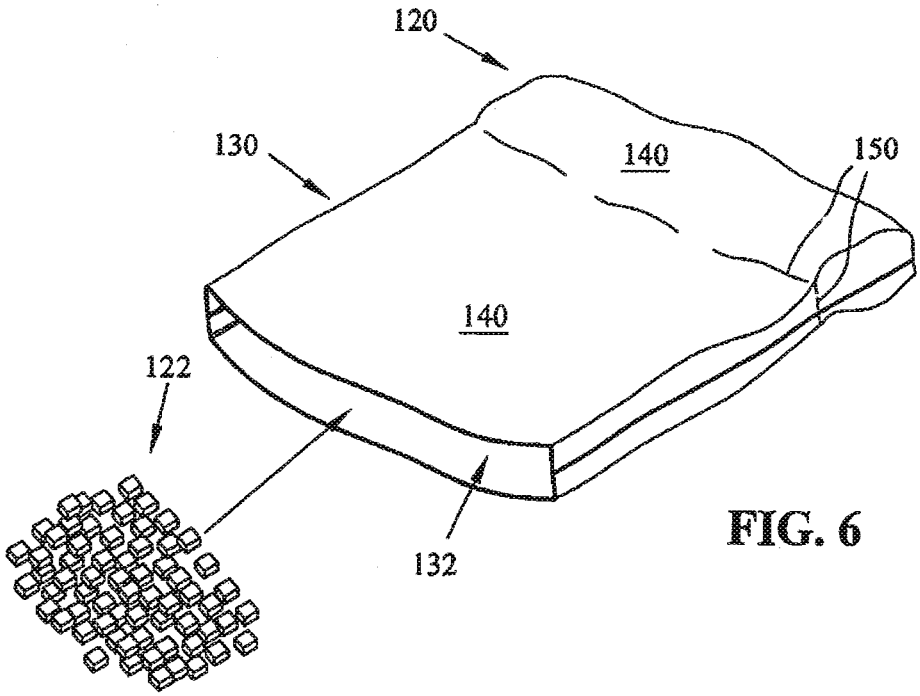
FIG. 6 is a perspective view of the pillow and sleeve of FIG. 5 wherein the barrier has not been seamed.

Another embodiment of pillow 120 and sleeve 130 is illustrated in FIG. 5. As illustrated, pillow portion 120 and sleeve portion 130 may be formed by a single piece of cloth 140. Pillow portion 120 defines a stuffing cavity 124. As shown in FIG. 6, stuffing 122 may be used to fill the stuffing cavity 124. Cloth 140 also includes sleeve portion 130. Sleeve portion 130 defines a core cavity 132 configured to receive core 12 (FIG. 2). Core cavity 132 may be configured to snugly fit core 12 (FIG. 2), allowing sleeve portion 130 to effectively attach cloth 140 to core 12 (FIG. 2).

Still referring to FIG. 6, barrier 150 separates pillow portion 120 from sleeve portion 130. Barrier portion 150 may be a suitable means of fastening cloth 140 to itself using any suitable means including, for example, heat sealing, thermal or sonic welding, adhesive bonding, and/or chemical bonding. Cloth 140 may use any suitable means including, for example, heat sealing, thermal or sonic welding, adhesive bonding, and/or chemical bonding, to create barrier 150.

Barrier 150 may include an external device used to separate stuffing cavity 124 from core cavity 132. The external barrier may be fastened to cloth 140 as part of barrier portion 150 using any suitable means including, for example, heat sealing, thermal or sonic welding, adhesive bonding, and/or chemical bonding. Similar to barrier 50, barrier portion 150 may allow core 12 (FIG. 2) to adjoin pillow portion 120.

Figure 7:
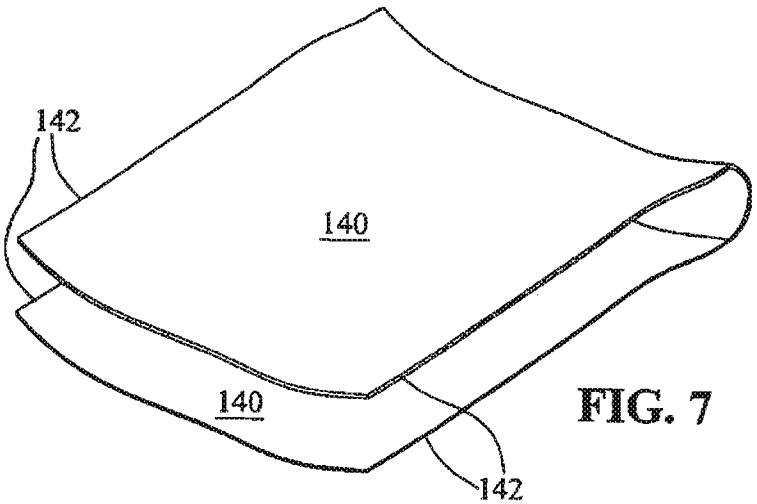
FIG. 7 is a perspective view of the pillow and sleeve of FIG. 6 wherein the cloth has not been seamed.

Now referring to FIG. 7, cloth 140 is shown including edges 142. Edges 142 may be seamed together in order to produce cloth 140 as shown in FIG. 6. Edges 142 may be seamed using any suitable means including, for example, heat sealing, thermal or sonic welding, adhesive bonding, and/or chemical bonding. In this embodiment, edges 142 may be seamed to the exterior or interior of cloth 140. In this embodiment, cloth 140 may be inverted to place seamed edges 142 to the interior or exterior of cloth 140.

FIGS. 5-7 illustrate a potential folding arrangement. FIGS. 3-4 illustrate an alternative folding arrangement. Other folding arrangements are considered and have been described as alternative folding arrangements. There are also alternative seaming or slit arrangements to facilitate alternative folding arrangements.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of integrating a pillow within an encapsulated mattress having a core and covering surrounding the core, the method comprising the steps of:

adjoining the pillow with the core using a sleeve, the pillow defining a first longitudinal end of the mattress and the core defining a second longitudinal end of the mattress, the first longitudinal end of the mattress being elevated relative to the second longitudinal end, and encapsulating the pillow with the covering.

2. The method of claim 1 further comprising the step of adjoining the sleeve to the pillow.

3. The method of claim 1 wherein the sleeve covers at least a portion of the core.

4. The method of claim 1 wherein the sleeve defines a core cavity, the core cavity at least partially encapsulating the core of the mattress.

5. The method of claim 1 further comprising the step of forming the pillow with cloth.

6. The method of claim 5 further comprising the step of forming a stuffing cavity within the cloth.

7. The method of claim 6 further comprising the step of filling the stuffing cavity with the stuffing.

8. The method of claim 7 further comprising the step of seaming the cloth to encapsulate the stuffing.

9. The method of claim 8 wherein the seam is located along a midpoint of the cloth.

10. The method of claim 9 wherein the cloth and the seam define a core cavity, the core cavity at least partially encapsulating the core of the mattress.

11. A method of integrating a pillow within an encapsulated mattress having a core and a covering surrounding the core, the method comprising the steps of:

forming the pillow with cloth;

forming a stuffing cavity within the cloth;

filling the stuffing cavity with a stuffing;

seaming the cloth to encapsulate the stuffing, a seam is located along a midpoint of the cloth, and the cloth and the seam define a sleeve having a core cavity, the core cavity at least partially encapsulating the core of the mattress;

adjoining the pillow with the mattress using a sleeve; and encapsulating the pillow with the covering.

12. A method of integrating a pillow within an encapsulated mattress having a core and a covering surrounding the core, the method comprising the steps of: providing a pillow having a sleeve with a length less than a length of the core; and adjoining the pillow to the mattress by sliding the sleeve over the core.

13. A method of integrating a pillow within an encapsulated mattress having a core and a covering surrounding the core, the method comprising the steps of:

forming the pillow with cloth;

filling a stuffing cavity within the cloth;

filling the stuffing cavity with a stuffing;

seaming the cloth to encapsulate the stuffing, where the cloth and the seam define a sleeve having a core cavity, the core cavity at least partially encapsulating the core of the mattress;

adjoining the pillow with the mattress using the sleeve; and encapsulating the pillow with the covering.

14. The method of claim 1, further comprising the step of encapsulating the core with the covering, wherein the sleeve is proximal a first portion of the core and the covering is proximal a second portion of the core.

15. The method of claim 14, wherein the covering is proximal the sleeve and the pillow.

16. The method of claim 1, wherein the pillow has a thickness greater than a thickness of the core.

* * * * *

UNITED STATES PATENT AND TRADEMARK OFFICE

CERTIFICATE OF CORRECTION

PATENT NO. : 8,458,836 B2
APPLICATION NO. : 13/349372
DATED : June 11, 2013
INVENTOR(S) : Timothy W. Shelby It is certified that error appears in the above-identified patent and that said Letters Patent is hereby corrected as shown below:

In the Claims:

In Claim 13, column 4, line 50, delete the word "filling" and replace therewith --forming--.

Signed and Sealed this
Twelfth Day of November, 2013

Teresa Stanek Rea

Teresa Stanek Rea
*Deputy Director of the United States Patent and Trademark Office*